United States Patent [19]

Shaw

[11] Patent Number: 4,519,156

[45] Date of Patent: May 28, 1985

[54] FIREARM WITH INTERCHANGEABLE BARRELS

[76] Inventor: Myron J. Shaw, Church St., Lee, Mass. 01238

[21] Appl. No.: 501,851

[22] Filed: Jun. 7, 1983

[51] Int. Cl.[3] ..... F41C 21/22

[52] U.S. Cl. ..... 42/77; 42/51; 42/75 A; 42/75 B

[58] Field of Search ..... 42/77, 51, 75 A, 75 B

[56] References Cited

U.S. PATENT DOCUMENTS

| | | | |
|---|---|---|---|
| 15,292 | 7/1856 | Halsey | 42/51 |
| 529,455 | 11/1894 | Marlin | 42/75 B |
| 1,024,989 | 4/1912 | Gruver | 42/75 A |
| 1,661,949 | 3/1928 | Krenek | 42/77 |
| 2,598,885 | 6/1952 | Bretton | 42/75 A |
| 3,842,527 | 10/1974 | Low | 42/75 B |
| 3,883,977 | 5/1975 | McClure | 42/75 B |
| 4,137,663 | 2/1979 | Farber | 42/75 B |
| 4,215,502 | 8/1980 | Loven | 42/51 |

OTHER PUBLICATIONS

*The Muzzle Loading Cap Lock Rifle,* N. H. Roberts, Bonanza Books (New York), 1952, pp. 19, 38.

*Primary Examiner*—Charles T. Jordan
*Assistant Examiner*—Ted L. Parr
*Attorney, Agent, or Firm*—Sidney Greenberg

[57] ABSTRACT

Firearm of muzzle-loading type is constructed to provide ready attachment of different barrels, such as a rifle or shotgun barrel, having different sizes to the same butt stock. The butt stock is provided with a mounting plate on its front end which is threadably engaged by an adapter member secured to the breech end of the barrel. The adapter member has a rear plate portion which matches the shape of and is co-extensive with the mounting plate, and abuts the same in operative position. Yieldable locking means on the adapter member provides for ready locking and unlocking of the adapter member and mounting plate. Assembly of the barrel to the butt stock is made by screwing the adapter member into the mounting plate and locking the parts together in operative position.

14 Claims, 8 Drawing Figures

11
12
12a
12b
12c
13
14
14a
14b
14c
14d
14e
14f
17
18
20
20a
20b
20c
21
22
23
25
25a
25b
26
4
5
6
7
8

FIREARM WITH INTERCHANGEABLE BARRELS

The present invention relates to firearms, and more particularly concerns a firearm of muzzle-loading type having interchangeable barrels.

In recent years black powder firearms, i.e., muzzleloaders, have come into increased use for hunting various types of game. Depending on the game and the prevailing hunting laws, either shotguns (fowlers) or rifles are used. A disadvantage of having separate muzzleloaders of different type is that each firearm has its own characteristic shape, weight and balance, making it necessary for the user to adapt to each weapon. While muzzleloaders with interchangeable barrels are known, such prior firearms require the use of barrels of the same outside dimensions, necessitating a small gauge shotgun barrel and a large gauge rifle barrel.

It is an object of the present invention to provide an improved firearm of muzzle-loading type having interchangeable barrels which avoids the disadvantages of known firearms of this type.

It is a particular object of the invention to provide a firearm of the above type wherein the interchangeable barrels may be of the same or different outside dimensions and of various calibers.

Another object of the invention is to provide a firearm of the above type wherein the interchangeable barrels are readily and securely attached in operative position on the firearm and are easily detached therefrom.

It is another object of the invention to provide a novel method of assembling a firearm of the above type which is simple and readily carried out.

Other objects of the invention and advantages thereof will become apparent from the following description and the appended claims.

With the above objects in view, the present invention in one of its aspects relates to a firearm of muzzle-loading type adapted for interchangeable barrels comprising a butt stock having a front portion, mounting means secured to the butt stock at its front portion and having a front surface, adapter means having a front portion and a rear plate portion extending downwardly below its front portion, the rear plate portion being substantially co-extensive with and abutting the front surface of the mounting means, the mounting means and the adapter means having co-acting connecting means for removably securing the adapter means to the mounting means in abutting relation therewith, and barrel means secured at the front end of the adapter means and having a breech portion at its rear end abutting the adapter means at the front end thereof.

The invention will be better understood from the following description taken with the accompanying drawings, in which.

Figure 1:
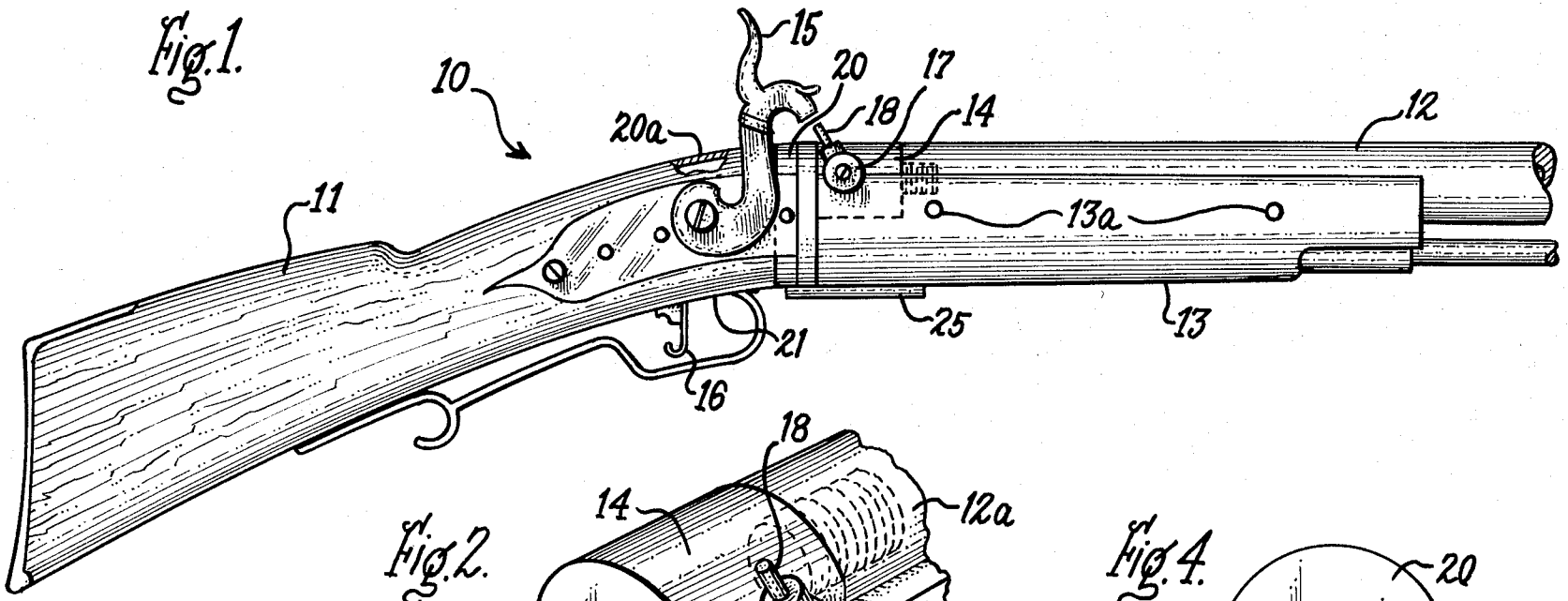
FIG. 1 is a fragmentary side elevational view of a firearm embodying the invention.
Figure 2:
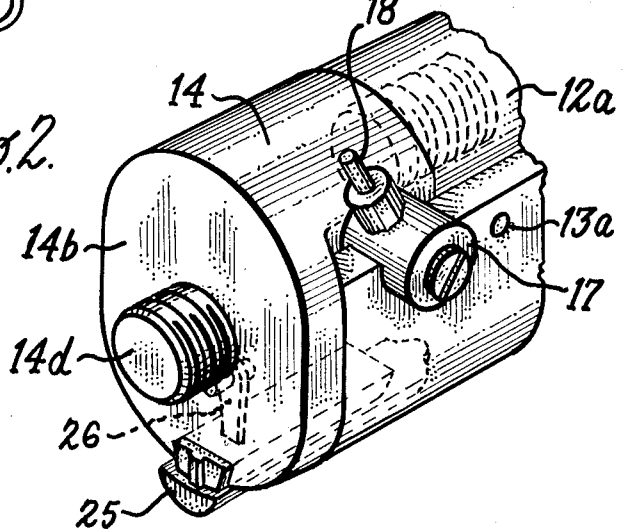
FIG. 2 is an enlarged perspective view of the adapter element incorporated in the firearm.

Referring now to the drawings, and particularly to FIG. 1, there is shown a firearm 10 of muzzle-loading type comprising butt stock 11 typically made of wood, barrel 12 to which wooden forestock 13 is secured, and adapter 14, herein also referred to as a bolster, which detachably interconnects butt stock 11 with barrel 12. The illustrated firearm is of the percussion firing type and includes hammer 15 pivotally attached to butt stock 11 and operated in conventional manner by trigger 16.

Figures 3, 5, 6, 7, 8:
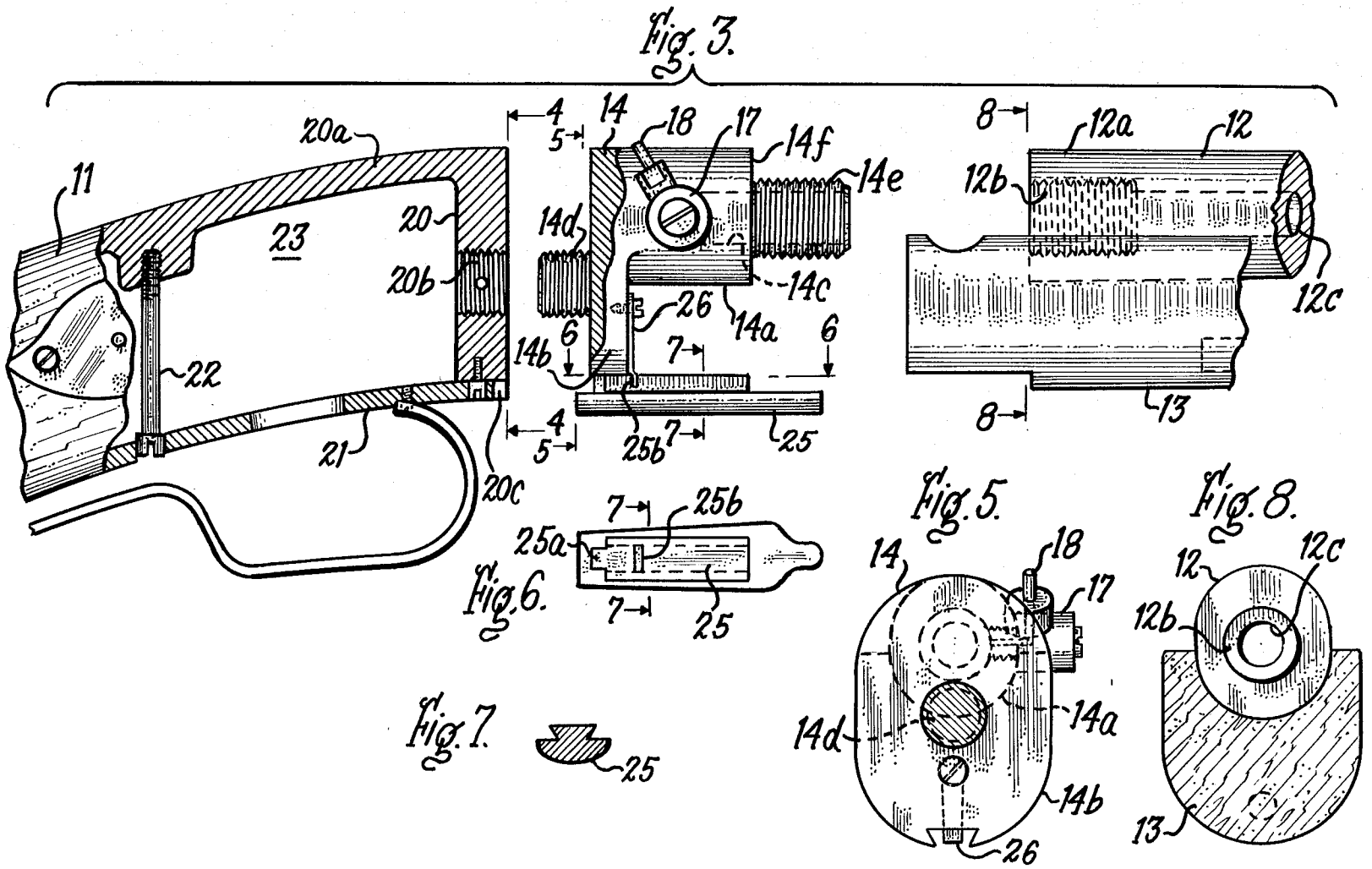
FIG. 3 is an exploded view, partly in section, of the firearm shown in FIG. 1, certain parts being omitted.
FIG. 5 is a view of the rear of the adapter element taken along the line 5—5 of FIG. 3.
FIG. 6 is a view of the key latch of the adapter element taken along the line 6—6 of FIG. 3.
FIG. 7 is a cross-sectional view of the key latch shown in FIG. 6.
FIG. 8 is a view of the rear of the barrel breech taken along the line 8—8 of FIG. 3.

Mounted on bolster 14 is drum 17 to which is attached nipple 18 on which a percussion cap (not shown) may be fitted for striking by hammer 15. As seen in FIGS. 3 and 5, the hollow nipple communicates with a passage in drum 17, which in turn communicates with a passage **14*c* in bolster 14**.

In the illustrated embodiment, the front end of butt stock 11 is equipped with a mounting device comprising a strip-shaped tang member **20*a* embedded in and extending along the top surface of the butt stock, and having integral therewith a tang (mounting) plate 20 which abuts and is substantially co-extensive with the front end face of butt stock 11. Formed centrally in mounting plate 20 is female threaded aperture 20*b*. As seen in FIG. 3, strip-shaped trigger plate 21 extending along the bottom surface of the butt stock is connected at its front end to the bottom of mounting plate 20 and at its rear end is secured to the butt stock by screw 22 which passes through the butt stock and threadably engages tang 20*a***.

Butt stock 11 is formed with a cavity 23 in which is located the operating mechanism by which trigger 16 operates hammer 15 for firing the weapon. Since this mechanism is of conventional type, a showing thereof has been omitted from the drawing as been unnecessary to an understanding of the invention.

The device provided in accordance with the invention for connecting the barrel and associated parts to butt stock 11 comprises bolster member 14 which in the illustrated embodiment is formed of main block **14*a* and rear bolster plate or flange 14*b* extending downwardly below the main block. Bolster plate 14*b* is formed centrally with a rearward male threaded projection 14*d* which is complementary to and engageable in female threaded aperture 20*b* in mounting plate 20 for detachably securing bolster 14 to butt stock 11 with the rear face of bolster plate 14*b* abutting the front face of mounting plate 20. At its front end, bolster block 14*a* is also centrally formed with a male threaded projection 14*e*, also referred to herein as a breech plug, which is formed with an axial passage aligned and communicating with passage 14*c* in bolster 14**.

Figure 4:
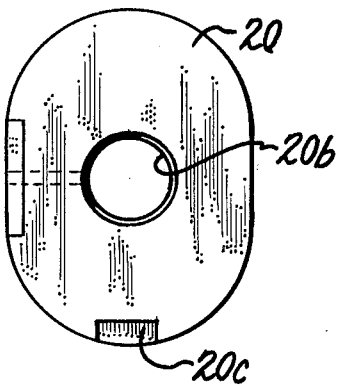
FIG. 4 is a view of the butt stock mounting device taken along the line 4—4 of FIG. 3.

Barrel 12, to which forestock 13 is secured by suitable means such as pins **13*a*, has an integral rear portion 12*a*, herein also referred to as the breech portion, formed with a female threaded aperture 12*b* for receiving breech plug 14*e* in threaded engagement for tightly securing bolster 14 to the barrel breech 12*a*. In the assembly, front shoulder 14*f* of bolster 14 abuts the rear end of barrel breech 12*a* and has an outer diameter substantially the same as the outer diameter of the latter. Barrel 12 illustrated in FIG. 3 is typically a rifle barrel having a bore 12*c*, which communicates with the passage in barrel breech 12*a*. When a shotgun barrel is used, the diameters of the bolster breech plug 14*e* and the front shoulder 14***f* of the bolster are typically larger than when a rifle barrel is used, to match the larger dimensions of the shotgun barrel. However, in any case, the dimensions of the rear face of rear bolster plate 14*b* are substantially the same as those of the front face of mounting plate 20 which it abuts in co-extensive relation. As seen in FIGS. 4 and 5, these faces are generally ovate or elliptical in shape. In a typical arrangement, the thickness of bolster plate 14*b* is $\frac{1}{4}$ inch and that of mounting plate 20 is $\frac{3}{8}$ inch.

In the assembly, mounting plate 20 and bolster 14 are held from twisting apart by a key latch 25 which, as seen in FIGS. 3 and 7, comprises a male dovetail member which slidingly fits into a female dovetail channel formed in the bottom of bolster plate 14*b*. *The rear end of key latch 25 has a projection 25a* which fits into a notch 20*c* at the bottom of mounting plate 20. Leaf spring 26 secured to bolster plate 14*b* extends into slot 25*b* in key latch 25 and urges the latter rearwardly to yieldably retain it in the mounting plate notch.

The invention thus provides a firearm which may have barrels of various types and sizes readily interchanged thereon in a simple and easy manner while retaining desirable ornamental appearance of the assembled firearm. By way of example, shotgun barrels ranging from 10 gauge to 20 gauge and rifle barrels of 32 caliber to 50 caliber may be selectively employed in the described firearm. Normally, each barrel is pre-assembled with a matching bolster (adapter) member before it is attached to the butt stock, each bolster having a rear bolster plate of the same size and shape so as to co-extensive with the butt stock mounting plate, as described above.

To assemble the firearm, the bolster with barrel and forestock attached is simply twisted into threaded engagement with mounting plate 20 until key latch 25 locks into place in the notch at the bottom of the mounting plate. To disassemble the firearm, key latch 25 is slid back by the thumb and the combined forestock, barrel and bolster are unscrewed from the mounting plate.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A muzzle-loading firearm adapted for interchangeable barrels comprising, in combination, a butt stock having a front end face, mounting means secured to said butt stock and having a front plate overlying said front end face, adapter means having a main front portion and a rear plate portion extending downwardly below said main front portion, the vertical dimension of said rear plate portion being substantially greater than the vertical dimension of the front portion, said rear plate portion being substantially co-extensive with and abutting said front plate of said mounting means, said mounting means and said adapter means having co-acting connecting means for removably securing said adapter means to said mounting means in abutting relation therewith, and barrel means secured at the front end of said adapter means and having a breech portion at its rear end abutting said adapter means at the front end thereof.

2. A firearm as defined in claim 1, said adapter means and said breech portion having second co-acting connecting means for securing said adapter means to said breech portion.

3. A firearm as defined in claim 2, said mounting means comprising a tang portion secured to and extending along the upper surface of said butt stock, said front plate extending downwardly from said tang portion and in abutment with said front end face of said butt stock and said rear plate portion of said adapter means.

4. A firearm as defined in claim 3, including lock means attached to said rear plate portion for locking said adapter means to said mounting means.

5. A firearm as defined in claim 4, said lock means comprising an elongated member in said rear plate portion at the bottom thereof and resilient means urging said elongated member rearwardly, said mounting means having an opening at the bottom thereof for receiving the rear end of said slidable member.

6. A firearm as defined in claim 1, said co-acting connecting means comprising complementary threaded means on said mounting means and said adapter means.

7. A firearm as defined in claim 6, said complementary threaded means comprising threaded projecting means on said adapter means and threaded aperture means on said mounting means.

8. A firearm as defined in claim 2, said second co-acting connecting means comprising threaded aperture means in said breech portion and complementary threaded breech plug means projecting from said adapter means into said threaded aperture means.

9. A firearm as defined in claim 1, and forestock means secured to said barrel means.

10. A firearm as defined in claim 1, said rear plate portion of said adapter means and said front plate of said mounting means being elliptical in shape.

11. A firearm as defined in claim 5, said elongated slidable member having a slot therein, said resilient means comprising spring means secured to the front side of said rear plate portion and extending into said slot.

12. A firearm as defined in claim 1, wherein said barrel means includes interchangeable barrels having breech portions of different diameters.

13. The method of assembling interchangeable barrels of different size and caliber on the same butt stock of a firearm, wherein the butt stock has a mounting means at its front end and the barrel has an adapter member secured thereto at its breech end, comprising the steps of threadably engaging the adapter member in said mounting means so that the adapter member and mounting means are in operative position, and locking the thus engaged adapter member and mounting means against rotation in said operative position.

14. A firearm as defined in claim 1, the rear end of said breech portion being substantially co-extensive with the front end of said adapter means, the difference between the vertical dimensions of said rear plate portion and said front portion of said adapter means being variable from one adapter to another.

* * * * *